US005181298A

United States Patent [19]

Horita et al.

[11] Patent Number: 5,181,298

[45] Date of Patent: Jan. 26, 1993

[54] PULL TAB FOR SLIDE FASTENER SLIDERS

[75] Inventors: Yoshiyuki Horita, Toyama; Susumu Ishii; Toshiaki Takizawa, both of, Kurobe, all of Japan

[73] Assignee: Yoshida Kogyo K. K., Tokyo, Japan

[21] Appl. No.: 654,512

[22] Filed: Feb. 13, 1991

[30] Foreign Application Priority Data

Feb. 14, 1990 [JP] Japan ..... 2-13376[U]

[51] Int. Cl.[5] ..... A44B 19/26

[52] U.S. Cl. ..... 24/429; 24/431

[58] Field of Search ..... 24/429, 431; 16/DIG. 24, DIG. 41, 121, 109

[56] References Cited

U.S. PATENT DOCUMENTS

| | | | |
|---|---|---|---|
| 229,603 | 7/1880 | Greenleaf | 16/109 |
| 445,192 | 1/1891 | Nye et al. | 16/121 |
| 1,475,654 | 11/1923 | Shea | 16/121 |
| 1,547,464 | 7/1925 | Styau | 16/121 |
| 1,564,015 | 12/1925 | Perkins | 16/121 X |
| 1,763,066 | 6/1930 | Rooney | 16/DIG. 24 |
| 1,932,056 | 10/1933 | Weatherhead, Jr. | 16/121 |
| 1,974,297 | 12/1990 | Akashi | 24/429 |
| 2,442,454 | 6/1948 | Bodell . | |
| 3,513,720 | 5/1970 | Allport | 16/121 X |
| 4,974,297 | 12/1990 | Akashi | 24/429 |

FOREIGN PATENT DOCUMENTS

| | | | |
|---|---|---|---|
| 0303217 | 8/1987 | European Pat. Off. . | |
| 0369258 | 11/1988 | European Pat. Off. . | |
| 348300 | 2/1922 | Fed. Rep. of Germany . | |
| 917868 | 11/1945 | France . | |
| 63-196608 | 12/1988 | Japan . | |
| 1-158711 | 11/1989 | Japan . | |
| 214046 | 4/1924 | United Kingdom | 16/121 |
| 281982 | 10/1927 | United Kingdom . | |

*Primary Examiner*—James R. Brittain

*Attorney, Agent, or Firm*—Hill, Steadman & Simpson

[57] ABSTRACT

A pull tab comprises a metal link portion having a first end pivotally connected with a slider body and a second end adapted for connection with a pull tab body, a pull tab body made of natural products such as ivory, shell etc. having at one end a cross-sectional shape substantially identical with that of the second end of the link portion; and structure for connecting the other end of the link portion and the pull tab body. Various materials for the pull tab body are available to meet various tastes of consumers.

22 Claims, 4 Drawing Sheets

PULL TAB FOR SLIDE FASTENER SLIDERS

BACKGROUND OF THE INVENTION

1. Field of the Invention:

The present invention relates to a pull tab for a slide fastener slider and particularly relates to a pull tab which is highly decorative and made of various materials to suit a variety of tastes.

2. Description of the Prior Art:

Usually, a pull tab is made of the same material as a slider body to which it is to be attached. Generally, the slider body is stamped from a blank metal sheet or molded from metal such as zinc alloy. In addition, it may be made from hard plastic, although it is unusual.

As a result, the pull tab is usually made of metal. It may be made from plastic, although it is rare. The conventional slider and particularly the pull tab is uniform in shape, design and construction. It is thus commonly considered that the slider appeals less to consumers than buttons or other types of fastening devices.

These days, it is often said that tastes and consumer demands concerning products are diversified. Furthermore, consumers desire to have what others do not. Because the fashion industry is increasingly appealing to individual tastes, even the smallest product such as pull tabs have a niche in the market.

Heretofore, there has been a slider pull tab part of which is made of rubber or of like materials, as shown in Japanese Utility Model Laid-open Publication No. 63-199608. However, the use of the rubber here in this publication is intended for only the practical purpose of ensuring grasp of the pull tab and is not intended for aesthetic purposes.

Addition of decorativeness to a slider pull tab and individualization thereof would inevitably give rise to a considerable increase in manufacturing cost. Moreover, it would lead to difficulty in maintaining mechanical strength. Therefore, the conventional slider pull tab has been uniform or less individual in appearance, hence appealing less to consumers.

However, since it is now the era when individualization of products is sought, a pull tab must meet the tastes of various individuals. Furthermore, a pull tab must meet the general requirements to be strong enough for manipulating the slider, while maintaining competitive cost of production.

SUMMARY OF THE INVENTION

With the foregoing difficulties in view, it is therefore an object of the present invention to provide a pull tab for a slide fastener slider which is strong, decorative, individual, and competitive in price.

According to the present invention, there is provided a pull tab to be pivotally joined with a slider body of a slide fastener slider for manipulating the slider, the pull tab comprising: a link portion having one end pivotally connected with the slider body; a pull tab body having at one end a cross-sectional shape substantially identical with that of the other end of the link portion; and means for connecting the other end of the link portion and the one end of the pull tab body.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
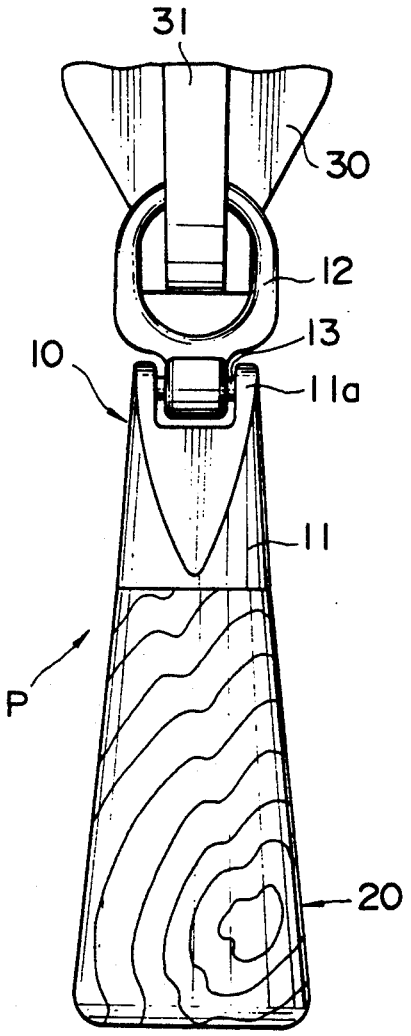
FIG. 1 is a front view of a pull tab according to a first embodiment of the present invention, showing it attached to a slider body.
Figure 2:
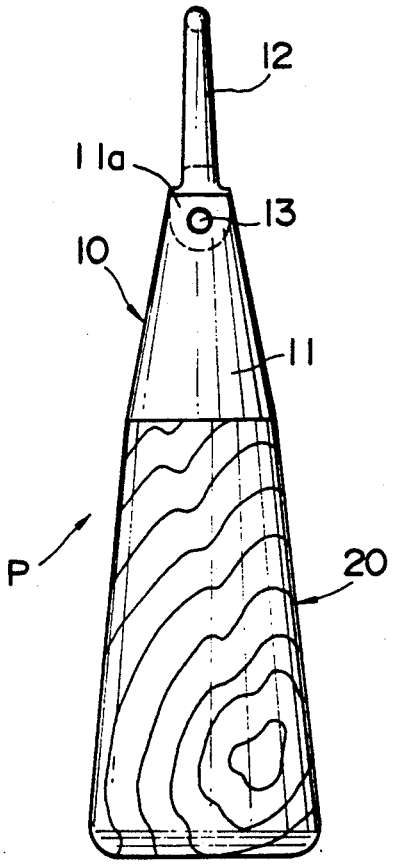
FIG. 2 is a side view of the pull tab shown in FIG. 1.
Figure 3:
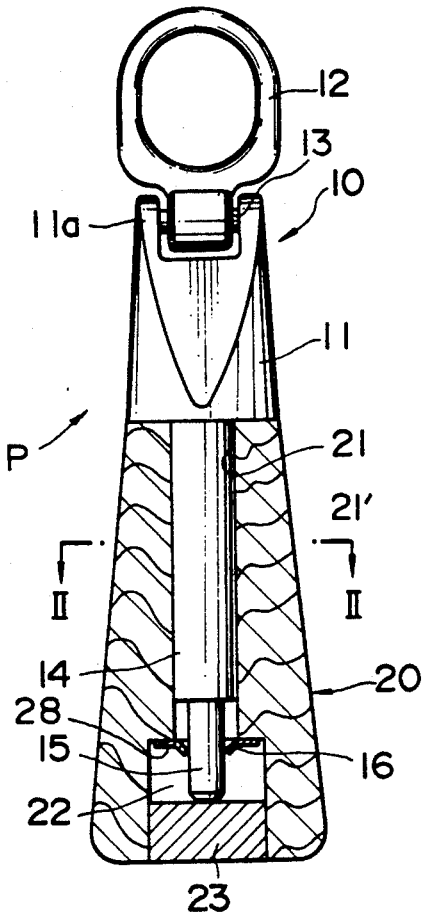
FIG. 3 is a front view, partly cross-sectional, of the pull tab of FIG. 1.

FIG. 1 shows that a pull tab P according to the present invention is pivotally joined with a slider body 30.

As clearly shown in FIG. 1, the pull tab P is of two-piece construction; that is, it comprises a link portion 10 made of metal and a pull tab body 20 made of natural material such as wood and connected to the link portion 10 in end-to-end relation, as closely described hereinafter. The metal link portion 10 comprises a link proper 11 substantially in the shape of truncated cone and an attaching ring portion 12 pivotally connected to one end of the link proper 11. Specifically, the link proper 11 has a pair of opposed side flanges 11*a*, 11*a* on the vertex plane of the truncated-conical link proper 11. A horizontal pivotal pin 13 is provided integrally between the side flanges 11*a*, 11*a*. The ring portion 12 is pivotally connected at its one end to the pivotal pin 13 and at the other end to an attachment lug 31 of a slider body 30 in the manner commonly known in this field, as shown in FIG. 1.

FIGS. 1 through 4 show the first embodiment of the present invention. In this embodiment, the link proper 11 of the shape described above has one end pivotally connected to the ring portion 12 via the horizontal pivotal pin 13, and has the other end provided with a support shaft 14 extending axially from the other end thereof. The support shaft 14 has at its distal end a small-diametered head portion 15.

The wooden pull tab body 20 is substantially cylindrical and has at one end a substantially identical cross-sectional shape with that of the other end of the link proper 11. The pull tab body 20 has a through hole 21 formed axially therethrough. The through hole 21 comprises a small-diametered hole portion 21' extending from the one end and a large-diametered hole portion 22 communicating with the small-diametered hole portion 21' via a circumferential step 28 and being open at the other end. The small-diametered hole portion 21' has substantially the same inside diameter as the diameter of the support shaft 14 of the metal link portion 10.

In order to connect the metal link portion 10 and the wooden pull tab body 20; first, the support shaft 14 of the the metal link portion 10 is inserted into the through hole 21 from its small-diametered hole portion 21' until the other end of the link proper 11 abut on the one end of the pull tab body 20, when the small-diametered head portion 15 of the support shaft 14 protrudes partly beyond the circumferential step 26 into the large-diametered hole portion 22. Then, the protuberant small-diametered head portion 15 is fastened to the circumferential step 28 by a resilient collar 16 of the construction as closely described hereinbelow. As better shown in FIG. 4, the resilient collar 16 is in the shape of circular metal sheet having a central circular aperture **16*a* disposed in its center and several radial notches 16 formed radially therefrom to thus define several resilient fins 16*c* therebetween. The central aperture 16*a* is slightly smaller in diameter than the small-diametered head portion 15 of the support shaft 14. The resilient collar 16 of this construction is put into the large-diametered hole portion 22 and is forced inward against resiliency of the resilient fins 16*c* with its center aperture 16*a* pierced by the small-diametered head portion 15 of the support shaft 14 until the resilient collar 16 rests flatly against the circumferential step 28, when the resilient fin 16*c* retains the small-diametered head portion 15 to the circumferential step 28 under its resiliency. As a result, the protuberant small-diametered head portion 15 of the support shaft 14 is fastened to the circumferential step 28 by the resilient collar 16 so that the link portion 10 is connected to the pull tab body 20**.

For the purpose of concealing the large-diametered hole portion 22 of the through hole 21 which would damage the appearance of the pull tab P otherwise, the large-diametered hole portion 22 is covered with a covering lid 23 which is made of wood or other adequate material.

Figure 5:
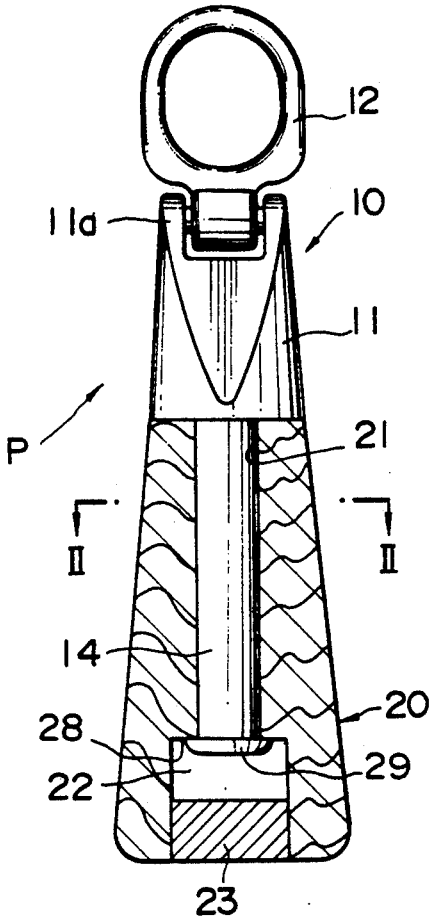
FIG. 5 is a view similar to FIG. 3 but showing a pull tab according to a second embodiment of the present invention.
Figure 4:
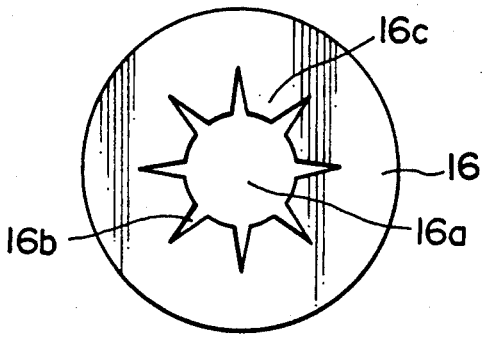
FIG. 4 is a circular collar used in the pull tab of FIG. 1.

FIG. 5 shows a second embodiment of the present invention. This embodiment is substantially identical with the first embodiment with the exception that the support shaft 14 is uniform in diameter throughout length and that the distal end of the support shaft 14 is flattened or otherwise deformed at 29 on the circumferential step 28 so that the metal link portion 10 and the pull tab body 20 are firmly connected to each other.

Figure 6:
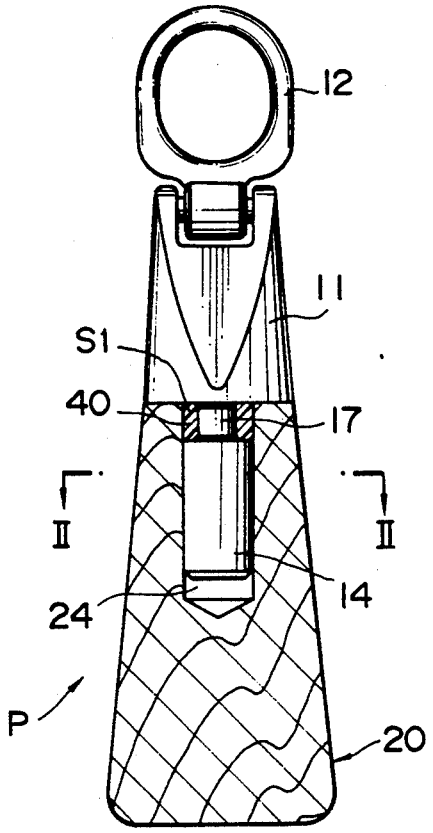
FIG. 6 is a view similar to FIG. 3 but showing a pull tab according to a third embodiment of the present invention.
Figure 7:
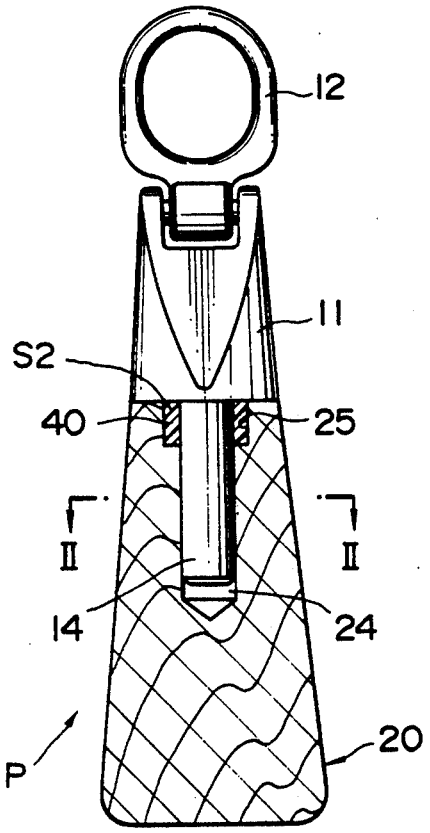
FIG. 7 is a view similar to FIG. 3 but showing a pull tab according to a fourth embodiment of the present invention.

FIGS. 6 and 7 show third and fourth embodiments, respectively, of the present invention, wherein adhesive 40 is applied for connection of the metal link portion 10 and the pull tab body 20. In these embodiments, the support shaft 14 is devoid of the small-diametered head portion 15 referred to in explaining the first embodiment. And, the support shaft 14 is made much shorter than those shown in the first and second embodiments. In addition, instead of the through hole 21 in the first and second embodiments, the pull tab body 20 has a blind hole 24 which is deep enough to receive the support shaft 14 therein.

In the third embodiment shown in FIG. 6, the support shaft 14 has at its proximal end a small-diametered neck portion 17; while in the fourth embodiments shown in FIG. 7, the blind hole 24 has at its open end a large-diametered recess 25. Formation of the small diametered neck portion 17 on the support shaft 14 (FIG. 6) gives rise to a cylindrical space S1 defined between the inner periphery of the blind hole 24 and the outer periphery of the small-diametered neck portion 17 of the support shaft 14. Likewise, formation of the large-diametered recess 25 in the blind hole 24 (FIG. 7) give rise to a cylindrical space S2 between the inner periphery of the large-diametered recess 25 and the outer periphery of the support shaft 14. Advantageously, these spaces S1 and S2 function to hold adhesive 40 therein, as closely described hereinbelow.

In order to assemble the pull tab P shown in FIGS. 6 and 7; first, adhesive 40 is injected into the blind hole 24 of the pull tab body 20. Then, the support shaft 14 of the metal link portion 10 is inserted into the blind hole 24 of the pull tab body 20. If the amount of the adhesive 40 is set adequate, then all the adhesive 40 is finely retained in the spaces S1, S2 against leakage through between the metal link portion 10 and the pull tab body 20, which would destroy the appearance of the resultant pull tab P. Eventually, the adhesive solidifies so that the metal link portion 10 and the pull tab body 20 are connected with each other firmly.

Figure 8:
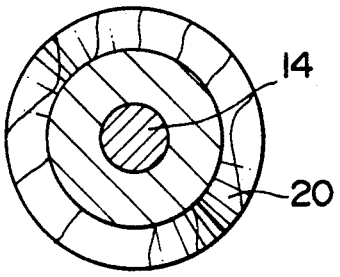
FIG. 8 is a cross-sectional view taken on lines II—II of FIGS. 3, 5, 6 and 7.
Figure 9:
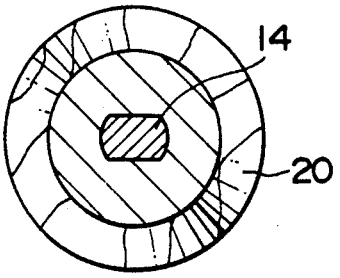
FIG. 9 is a view identical to FIG. 8 except that the cross-sectional shape of a support shaft is substantially rectangular of being circular in FIG. 8.

Although, in all the preceding embodiments, the support shaft 14 of the metal link portion 10 and the through hole 21 or the blind hole 24 to insert it through are all circular in cross-section, as shown in FIG. 8; the cross-section is not limited to this. Instead of a circle, a variety of non-circular cross-sectional shapes such as a ellipse shown in FIG. 9 or a polygon may be used. If being made in non-circular cross-section, then the support shaft 14 could prevent the metal link portion 10 and pull tab body 20 from accidental rotation relative to each other on the support shaft 14.

Figure 10:
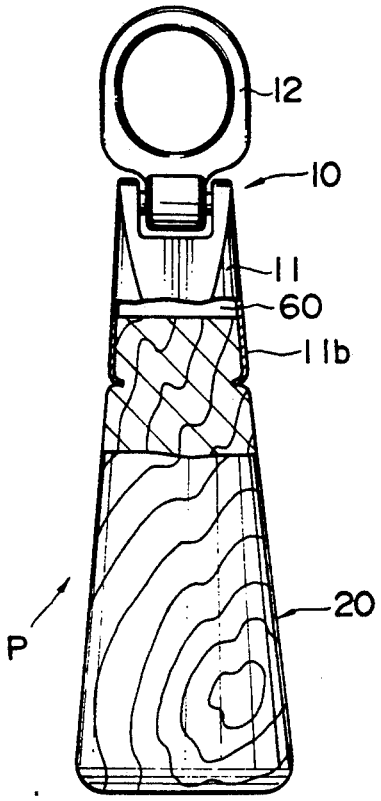
FIG. 10 is a view similar to FIG. 3 but showing a pull tab according to a fifth embodiment of the present invention.

FIG. 10 shows the fifth embodiment of the present invention. This embodiment is substantially identical with the first embodiment except that, instead of having the support shaft 14, the metal link portion 10 has a skirt portion **11*b* on the other end to define a hollow 60 therein. The one end of the pull tab body 20 is fit into the hollow 60. Then, the skirt portion 11*b* of the metal link portion 11 is pressed laterally against the pull tab body 20 so that the metal link portion 11 is connected firmly with the pull tab body 20**.

Figure 11:
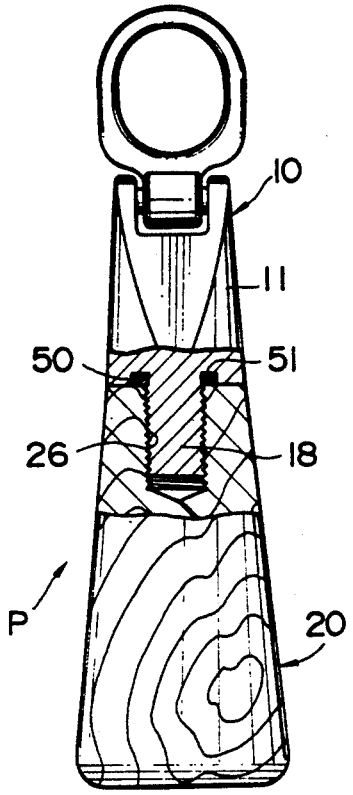
FIG. 11 is a view similar to FIG. 3 but showing a pull tab according a sixth embodiment of the present invention.
Figure 12:
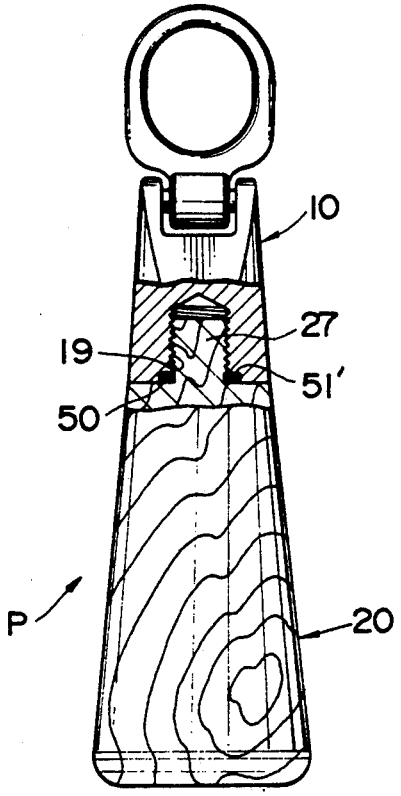
FIG. 12 is a view similar to FIG. 3 but showing a pull tab according to a seventh embodiment of the present invention.

FIGS. 11 and 12 shown sixth and seventh embodiments, respectively, of the present invention in which the metal link portion 10 and the pull tab body 20 are connected together with a screw.

In the sixth embodiment shown in FIG. 11, the metal link portion 10 has a threaded shaft 18 extending axially from the other end thereof, while the pull tab body 20 has a threaded hole 26 formed axially thereof for screwing the threaded shaft 18 thereinto. In the seventh embodiment shown in FIG. 12, the construction goes the other way around; that is, the metal link portion 10 has a threaded hole 19 formed axially thereof, while the pull tab body 20 has a threaded shaft 27 extending axially from the one end thereof.

It is often required that some mark or pattern be stamped or otherwise applied to the front surface of the pull tab body 20. In this connection, it is to be noted that, as shown in FIG. 11, a circumferential groove 51 is formed in the other end of the metal link portion 10 around the base of the threaded shaft 18. In FIG. 12, instead, a circumferential ledge 51' is formed in the other end of the metal link portion 10 around the open end of the threaded hole 19. The threaded shaft 18, 27 is screwed to the threaded hole 26, 19 with an elastic ring 50 made of rubber or the like material received in the circumferential groove 51 or the circumferential ledge 51'. The elastic ring 50 provided between the metal link portion 10 and the pull tab body 20 advantageously compensates for possible angular misalignment of the metal link portion 10 and the pull tab body 20 relative to each other, so as to make certain that the mark be oriented to the front.

In the embodiment shown in FIG. 12, the threaded shaft 27 of the pull tab body 20 has been screwed into the threaded hole 19 in the metal link portion 10. This means that, even if translucent material such as a tortoiseshell is used as material of the pull tab body 20, the threaded shaft 27 is concealed conveniently by the metal link portion 10, thus not damaging the appearance of the pull tab.

It is natural that the appearances and materials of the link portion 10 and pull tab body 20 are not limited to the embodiments shown herein. For example, instead of being made of wood as shown here, the pull tab body 20 may be made of any other natural materials such as ivory, tortoiseshell, shell and horn or quasi-natural materials or plastic resembling these natural materials in appearance. Similarly, instead of being made of metal as described here, the link portion 10 may be made of hard plastic which is commensurate in mechanical strength to metal.

Although the pull tab P according to the present invention is shown in FIG. 1 to be attached to the slider body 30, the pull tab P may be put on the market either attached to a slider body 30 or not attached to a slider body 30 as a loose pull tab P. After being purchased, the loose pull tab P can be attached to the slider body 30 which is purchased separately. In this event, the attaching ring portion 12 may be preferably so constructed as to be releasably connected with the pull tab P, as is disclosed in Japanese Utility Model Laid-open Publication No. 1-158711, in which case the metal link portion 10 must be provided with an annular portion for connection with the ring portion 12. Furthermore, even the metal link portion 10 and the pull tab body 20 as parts of the pull tab P may be dealt in separately on the market. Since link portions 10 and pull tab bodies 20 are available in various appearances and materials, one can purchase metal link portions 10 and pull tab bodies 20 as he wishes and combine them in various ways so as to meet various tastes of consumers.

With the construction of the present invention set forth hereinabove, the present invention enjoys the following advantages.

Severe stresses exerted by the operation of the slider focus on the metal link portion 10, so that the pull tab body 20 of natural material, as may be less strong intrinsically, is completely exempt from damage.

Since the means for connecting the link portion 10 and the pull tab body 20 is very simple and stout in construction, the pull tab can be assembled very easily and the resultant pull tab as a whole enjoys high mechanical strength.

Making the pull tab body 20 of natural materials such as wood, shell, horn, ivory, etc. would not only increase the decorativeness of the pull tab P as a whole but also provide their intrinsic mild texture which is not found in synthetic materials. Furthermore, since various combinations of materials for the link portion 10 and the pull tab body 20 are available, this pull tab P fits to the present days when individualization of products is respected.

Obviously, various modifications and variations of the present invention are possible in the light of the above teaching. It is therefore to be understood that within the scope of the appended claims the invention may be practiced otherwise than as specifically described.

What is claimed is:

1. A pull tab to be pivotally joined with a slider body of a slider fastener for manipulating the slider, the pull tab comprising:

a substantially frustoconical link portion having a first end pivotally connected with the slider body, and a second end adapted for connection to a pull tab body;

a pull tab body having an end portion having a cross-sectional shape substantially identical with a cross-sectional shape of said second end of the link portion; and means for connecting said second end of the link portion and the end portion of the pull tab body, the connecting means comprising a through hole formed axially through the pull tab body, the through hole having a small-diametered hole portion extending from the end portion of the pull tab body and a large-diametered hole portion communicating with the small-diametered hole portion via a circumferential step and being open at a second end portion of the pull tab body; a support shaft axially extending from the second end of the link portion and inserted through the small-diametered hole portion, and means provided in the large-diametered hole portion for fastening a distal end of the support shaft to the circumferential step.

2. A pull tab according to claim 1, the support shaft having at its distal end a small-diametered head portion, which protrudes beyond the circumferential step into the large-diametered hole portion; the fastening means comprising a resilient collar being in the shape of an annular metal sheet and having a central aperture disposed in is center and a plurality of radial notches formed radially therefrom to thus define a plurality of resilient fins therebetween, the central aperture being slightly smaller in diameter than the small-diametered head portion of the support shaft, the reslient collar rest flatly against the circumferential step with its center aperture pierced by the small-diametered head portion of the support shaft so that the resilient fin retains the small-diametered portion to the circumferential step under its resiliency.

3. A pull tab according to claim 1, the fastening means comprising the distal end of the support shaft protruding into the large-diametered hole portion which is deformed against the circumferential step.

4. A pull tab according to claim 1, the large-diametered hole portion being covered with a covering lid.

5. A pull tab according to claim 1, the small-diametered hole portion and the support shaft having a circular cross-section.

6. A pull tab according to claim 1, the small-diametered hole portion and the support shaft having a non-circular cross-section.

7. A pull tab according to claim 1, the link portion being made of metal.

8. A pull tab according to claim 1, the pull tab body being made of natural material.

9. A pull tab to be pivotally joined with a slider body of a slider fastener for manipulating the slider, the pull tab comprising:

a substantially frustoconical link portion having a first end pivotally connected with the slider body, and a second end adapted for connection to a pull tab body;

a pull tab body having an end portion having a cross-sectional shape substantially identical with a cross-sectional shape of said second end of the link portion; and means for connecting said second end of the link portion and the end portion of the pull tab body, the connecting means comprising a blind hole formed axially of the pull tab body and being open in said first end portion of the pull tab body; a large-diametered recess formed in the open end of the blind hole; and a support shaft axially extending from said second end of link portion and inserted into the blind hole with adhesive filling the space defined between the inner periphery of the large-diametered recess and the outer periphery of the support shaft.

10. A pull tab according to claim 9, the link portion being made of metal.

11. A pull tab according to claim 9, the pull tab body being made of natural material.

12. A pull tab to be pivotally joined with a slider body of a slider fastener for manipulating the slider, the pull tab comprising:

a substantially frustoconical link portion having a first end pivotally connected with the slider body, and a second end adapted for connection to a pull tab body;

a pull tab body having an end portion having a cross-sectional shape substantially identical with a cross-sectional shape of said second end of the link portion; and means for connecting said second end of the link portion and the end portion of the pull tab body, the connecting means comprising a blind hole formed axially of the pull tab body and being open in said first end portion of the pull tab body; and a support shaft axially extending from said second end of the link portion and having at its proximal end a small-diametered neck portion, the support shaft inserted into the blind hole with adhesive filling the space defined between the inner periphery of the blind hole and the outer periphery of the small-diametered neck portion of the support shaft.

13. A pull tab according to claim 12, the link portion being made of metal.

14. A pull tab according to claim 12, the pull tab body being made of natural material.

15. A pull tab to be pivotally joined with a slider body of a slider fastener for manipulating the slider, the pull tab comprising:

a substantially frustoconical link portion having a first end pivotally connected with the slider body, and a second end adapted for connection to a pull tab body;

a pull tab body having an end portion having a cross-sectional shape substantially identical with a cross-sectional shape of said second end of the link portion; and means for connecting said second end of the link portion and the end portion of the pull tab body, the connecting means comprising a threaded shaft extending axially from said second end of the link portion and a threaded hole formed axially of the pull tab body, the threaded shaft being screwed into the threaded hole.

16. A pull tab according to claim 15, the link portion having a circumferential groove formed in said second end thereof around the base of the threaded shaft, the pull tab further including an elastic ring received in the circumferential groove.

17. A pull tab according to claim 15, the link portion being made of metal.

18. A pull tab according to claim 15, the pull tab body being made of natural material.

19. A pull tab to be pivotally joined with a slider body of a slider fastener for manipulating the slider, the pull tab comprising:

a substantially frustoconical link portion having a first end pivotally connected with the slider body, and a second end adapted for connection to a pull tab body;

a pull tab body having an end portion having a cross-sectional shape substantially identical with a cross-sectional shape of said second end of the link portion; and means for connecting said second end of the link portion and the end portion of the pull tab body, the connecting means comprising a threaded shaft extending axially from said first end portion of the pull tab body and a threaded hole formed axially of the link portion, the threaded shaft being screwed into the threaded hole.

20. A pull tab according to claim 19, the link portion having a circumferential ledge formed in said second end thereof around the open end of the threaded hole, the pull tab further including an elastic ring received in the circumferential ledge.

21. A pull tab according to claim 19, the link portion being made of metal.

22. A pull tab according to claim 19, the pull tab body being made of natural material.

* * * * *